US006401376B2

(12) United States Patent
Cumberland et al.

(10) Patent No.: US 6,401,376 B2
(45) Date of Patent: Jun. 11, 2002

(54) FRAME TYPE PHOTOGRAPH MOUNTING ASSEMBLY

(76) Inventors: Holly S. Cumberland; Todd C. Cumberland, both of 3650 Cross Creek La., Malibu, CA (US) 90265

( * ) Notice: Subject to any disclaimer, the term of this patent is extended or adjusted under 35 U.S.C. 154(b) by 0 days.

(21) Appl. No.: 09/752,479

(22) Filed: Jan. 2, 2001

Related U.S. Application Data

(63) Continuation-in-part of application No. 09/583,162, filed on May 30, 2000, which is a continuation-in-part of application No. 09/200,498, filed on Nov. 25, 1998, now Pat. No. 6,101,752.

(51) Int. Cl.[7] ..... A47G 1/16
(52) U.S. Cl. ..... 40/778; 40/777; 40/768
(58) Field of Search ..... 40/778, 777, 768, 40/773, 702, 159.1, 661.09, 594

(56) References Cited

U.S. PATENT DOCUMENTS

| | | | | |
|---|---|---|---|---|
| 1,342,248 A | | 6/1920 | Bloomquist | |
| 1,970,395 A | * | 8/1934 | Schaake | 40/776 |
| 2,068,909 A | | 1/1937 | Engel | |
| 2,093,598 A | | 9/1937 | Clark | |
| 2,517,535 A | | 8/1950 | Cross | |
| 2,622,055 A | | 12/1952 | Lieder | |
| 3,125,460 A | | 3/1964 | Rose | |
| 3,256,979 A | * | 6/1966 | Tschentschel | 40/778 |
| 3,624,688 A | | 11/1971 | Miller | |
| 3,766,676 A | | 10/1973 | Slemmons | |
| 4,016,664 A | | 4/1977 | Kaufmann | |
| 4,275,520 A | | 6/1981 | Appleton et al. | |
| 4,301,199 A | | 11/1981 | Pfanstiehl | |
| 4,378,647 A | | 4/1983 | Stancato | |
| 4,479,318 A | * | 10/1984 | Russell | 40/154 |
| 4,991,330 A | | 2/1991 | Heidari | |
| 5,076,432 A | * | 12/1991 | Wolf | 206/449 |
| 5,226,996 A | | 7/1993 | Schober | |
| 5,328,729 A | | 7/1994 | Lamonte, Jr. | |
| 5,433,023 A | | 7/1995 | Edwards et al. | |
| D361,601 S | * | 8/1995 | Goldman | D20/42 |
| 5,569,503 A | | 10/1996 | Piotroski | |
| 5,799,429 A | | 9/1998 | Speshyock | |
| 5,893,229 A | | 4/1999 | Werner | |
| 5,916,843 A | * | 6/1999 | Weller | 503/227 |
| 6,101,752 A | | 8/2000 | Cumberland | |

FOREIGN PATENT DOCUMENTS

| | | |
|---|---|---|
| FR | 960080 | 4/1950 |

* cited by examiner

*Primary Examiner*—Anthony Knight
*Assistant Examiner*—Mark Williams
(74) *Attorney, Agent, or Firm*—Brian B. Shaw, Esq.; Stephen B. Salai, Esq.; Harter, Secrest & Emery, LLP

(57) ABSTRACT

A photograph retaining assembly is disclosed, wherein a backing substrate has an adhesive layer on one side and a plurality of retaining pockets on a second side. The retaining pockets formed to preclude perforation of the backing substrate. The retaining pockets can form a frame extending along two, three or all four sides of the photograph, wherein the retaining pocket engages the retained photograph along at least three sides.

18 Claims, 15 Drawing Sheets

FIG.1
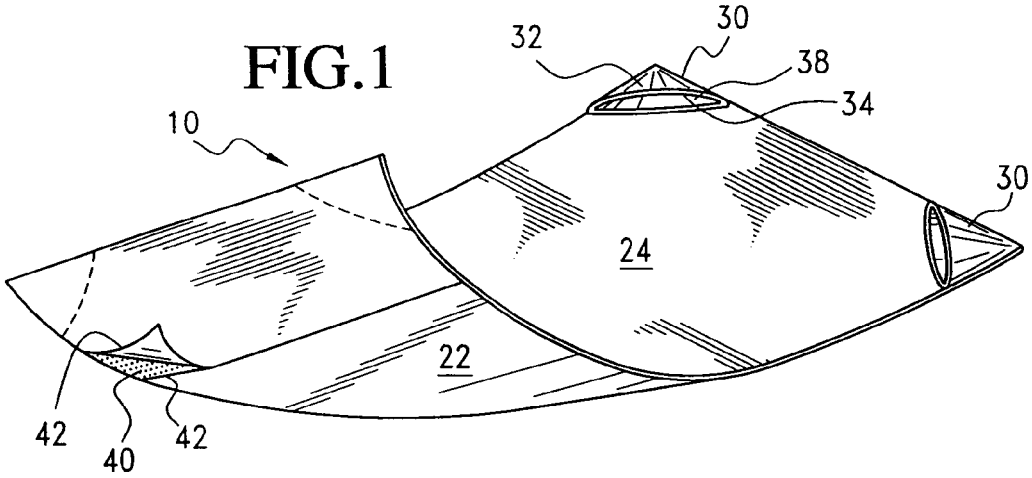
FIG.2
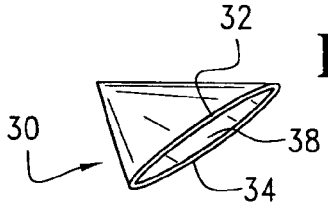
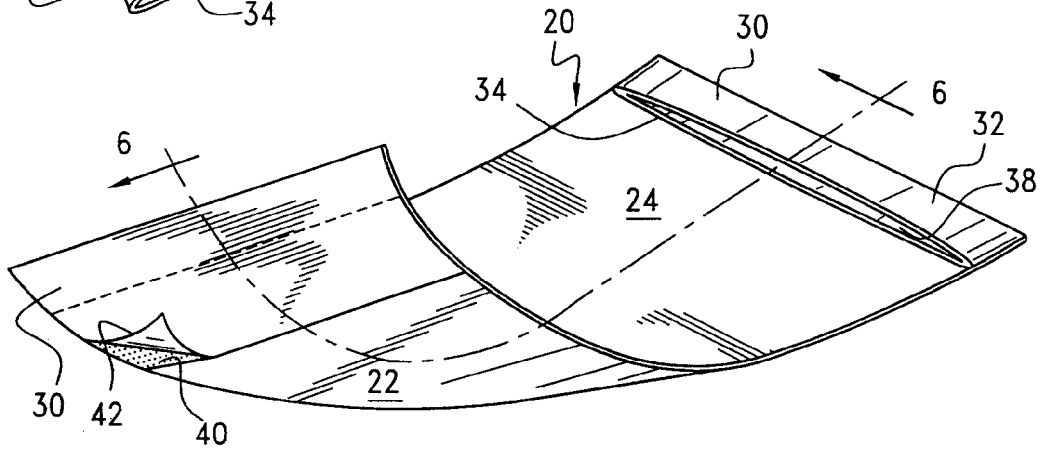
FIG.3
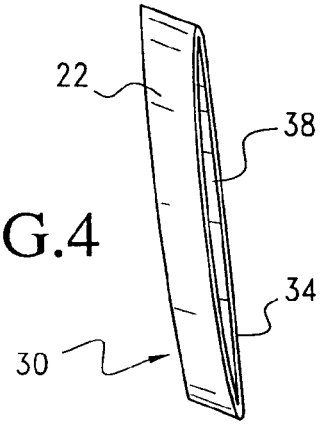
FIG.4

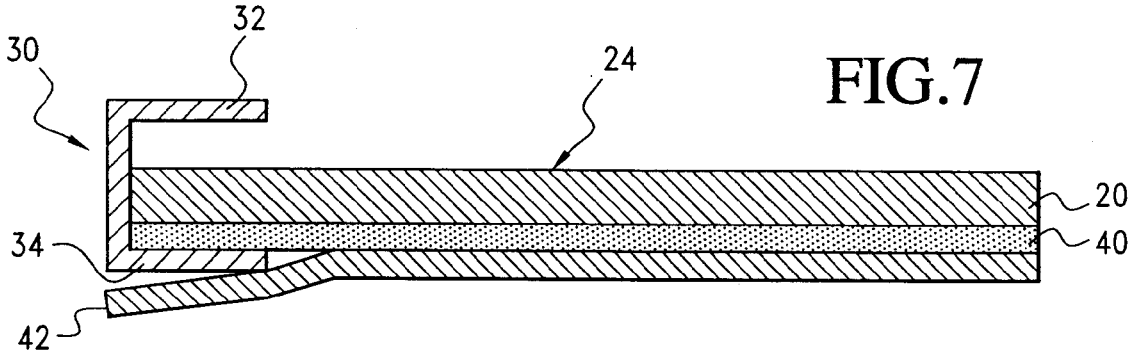
FIG.7
FIG.8
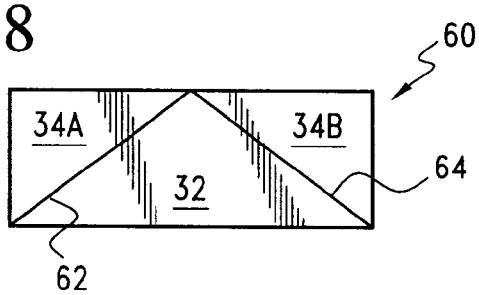
FIG.9
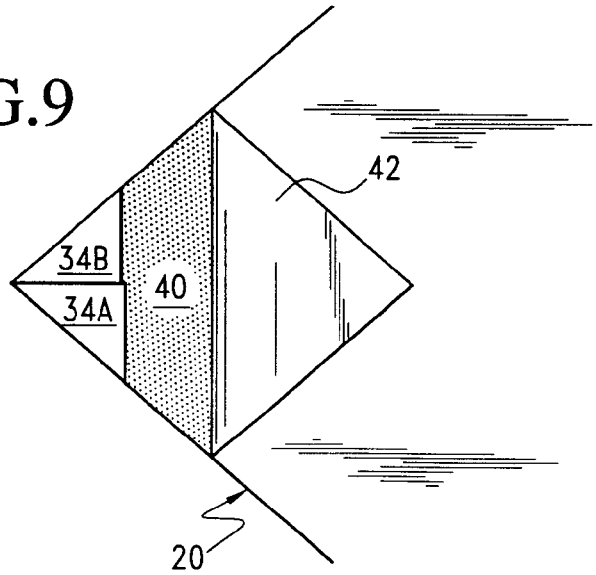

FRAME TYPE PHOTOGRAPH MOUNTING ASSEMBLY

The present application is a Continuation-in-Part of U.S. Ser. No. 09/583,162 filed May 30, 2000 in the name of Holly S. Cumberland, which is a Continuation-in-Part of U.S. Ser. No. U.S. Ser. No. 09/200,498 filed Nov. 25, 1998 in the name of Holly S. Cumberland, now U.S. Pat. No. 6,101,752 issuing Aug. 15, 2000.

FIELD OF THE INVENTION

The present invention relates to an assembly for releasably mounting images, and more particularly to the releasable retention of a photograph to a page, wherein the photograph and a mount are simultaneously aligned with each and may be aligned and adhered to the page as a single element.

BACKGROUND OF THE INVENTION

The storage and display of images, such as photographs, often significantly contribute to the value. That is, if a picture is never displayed, its value will likely not be realized. Even if the picture is displayed, the mounting of the picture may significantly contribute to its degradation. Unfortunately, many current mounting components tend to deteriorate over time, thereby creating the risk of releasing the photograph from the mount. In addition, some mounts may actually degrade the retained photograph. This deterioration of the photograph can result from contact or exposure of the mount to the photograph. Chemicals from the mount may leech into the photograph and distort the image quality.

A further problem exists in mounting a picture to a given page in a desired location. Thus, misalignment often occurs. Devices employed for mounting pictures have utilized double-sided adhesive stickers which were stuck to the back of picture at the corners and then stuck to a mounting sheet by moistening the stickers. However, these adhesives are generally harmful to the photograph or prohibitively expensive.

Alternatively, slits in a mounting sheet have been used to retain a photograph with respect to the sheet. The slits are cut in the sheet and allow no user modification. Thus, there is no ability to locate the photograph in a particular location on a page.

A further problem arises when the photograph is formed or imaged on a relatively flexible, flimsy stock. Current digital imaging equipment and associated printers often employ thermal paper as the stock. The thermal paper does not exhibit the resiliency and strength of traditional photograph paper stock. The increasing use of digital imaging and the associated use of thermal paper or similar stock has created an increased percentage of images on thinner, more flexible stock than traditional photographic paper.

Therefore, the need exists for a retention system that can retain a photograph without exposing the photograph to damaging adhesives. The need also exists for a system in which photographs are operably aligned with a mount or retainer, and the combination can be readily aligned with a page. A further need exists for a system that can be readily located with respect to a page such that a resulting location of the photograph is visible during the mounting process. The need also exists for retaining photographs from printers, including thermal, ink jet and laser printers, wherein the media upon which these photographs are formed can be relatively limp or flimsy. That is, there is a need to retain photographs by engaging a substantial portion of the periphery and reducing unintended separation of the photograph from the mount.

SUMMARY OF THE INVENTION

The present invention provides a mounting system that allows a photograph to be operably retained with respect to the mount and the combined photograph and mount to be located with respect to a support. The invention is particularly directed to mounting planar images such as photographs with respect to a support such as a page in an album.

One configuration of the present invention includes a backing substrate having an adhesive on one planar surface that retains the backing substrate with respect to the support and a second planar surface of the backing substrate having a plurality of overlay areas, configured as retaining pockets, to retain a portion of a periphery of the photograph.

The present invention provides a mount for photographs, wherein no plastic layer is disposed over the face of the photograph to retain the photograph. Only a portion of the periphery of the photograph is covered in the present invention. Further, the portion of the periphery may be a corner or an edge of the photograph.

The present invention offers the benefit of simultaneously locating the photograph and associated mount to a page of a photo album. Specifically, the present invention obviates the need to locate and temporarily retain multiple individual corner supports to an album page. By providing a system having all the retaining pockets affixed to a substrate, the photograph and the substrate will not be subject to unintended separation, and accurate alignment with the album page is readily achieved.

In a frame configuration, the invention provides a frame for engaging 2, 3 or 4 edges of a photograph (the photograph being a quadrilateral). In a further configuration, the frame can be formed of a different material than the substrate. That is, the frame can be formed of an archival quality material which reduces degradation to the photograph. In addition, the frame configuration engages the photograph along three or four sides of the photograph, thereby enhancing retention of flexible or flimsy stock photographs. The frame configuration also allows for a selective closure or sealing of the frame to retain the photograph relative to the frame.

BRIEF DESCRIPTION OF THE DRAWINGS

FIG. 1 is a perspective view of a first embodiment of the present invention.

FIG. 2 is a perspective view of a retaining pocket in the first embodiment.

FIG. 3 is a perspective view of a second embodiment of the invention.

FIG. 4 is a perspective view of an expanded retaining pocket for receiving a portion of the periphery of a planar image.

FIG. 7 is a partial cross-sectional view of an alternative construction.

FIG. 8 is a top plan view of a pocket-forming element.

FIG. 9 is a partial perspective view of the substrate and alternative pocket configuration.

DETAILED DESCRIPTION OF THE PREFERRED EMBODIMENT

Figure 5:
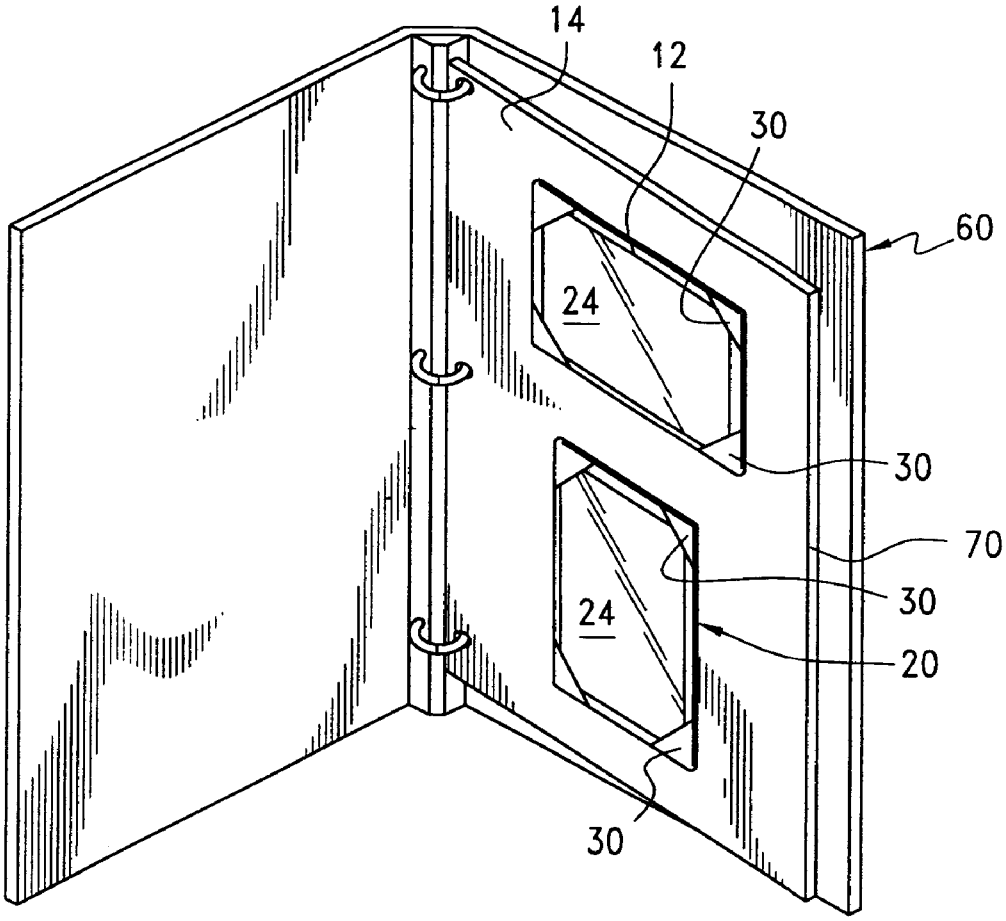
FIG. 5 depicts a support bearing two mounted backing substrates.

As shown in FIGS. 1 and 5, the present invention provides a mounting system 10 for locating a planar image 12 with respect to a support 14. The planar image 12 may be a print, a painting a photograph, drawing or other image. It is understood the planar image 12 may be formed on a relatively sturdy stock that is self supporting, or on a stock that is generally limp and requires external support. For purposes of the present description, the planar image 12 is set forth as a photograph. The support 14 may be a wall, a tabletop, or any surface with which the planar image 12 is to be displayed. For purposes of the present description, the support 14 is a page in a photo album.

Generally, the present invention includes a backing substrate 20 and a plurality of retaining pockets 30.

FIG. 1 shows a first embodiment of the invention including the backing substrate 20. Preferably, the backing substrate 20 has a first and a second planar surface 22, 24. The first planar surface 22 includes the adhesive material 40 and the second planar surface 24 contacts a rear surface of the photograph. The adhesive material 40 may be any variety of materials such as permanent or releasable adhesives. Preferably, the backing substrate 20 is non-degrading with respect to the planar image 12. A backing substrate 20 sold under the trademark CHARTPAK by Chartpak of Massachusetts has been found to be an acceptable material. The backing substrate 20 is impervious to the adhesive material 40 so that migration of the adhesive material from the first surface 22 to the second surface 24 is substantially precluded. Preferably, the adhesive layer 40 is initially covered by a releasable film 42 that is readily removed to expose the adhesive layer.

The second surface 24 of the backing substrate 20 includes the retaining pockets 30. The retaining pockets 30 are formed by an overlying member 32 that overlies a portion of the backing substrate 20. The overlying member 32 may be a portion of the backing substrate that has been folded to overlie the second surface 24. Alternatively, the overlying member 22 may be a separately formed member that is attached to the second surface 24 of the backing substrate 20. In a further configuration, the retaining pocket 30 may have a bottom 34 and the overlying member 22 joined along three sides, or so as to define a pocket having an opening 38. An outside of the bottom 34 will be joined to the second surface 24 of the backing substrate 20. The retaining pocket 30 may be joined to the backing substrate 20 by any of a variety of mechanisms such as adhesives, welding heat treating or other fixedly attaching process. The retaining pockets 30 have the opening 38 into which a portion of the planar image 12 is received. The retaining pockets 30, shown in FIG. 1 and FIG. 2, are constructed to encompass a corner of the planar image 12 to be retained. The retaining pockets 30 are preferably formed of an archival material that will not degrade the planar image 12.

The retaining pockets 30 may separately formed from the backing substrate 20 and affixed to the substrate at any location. Thus, a user may identify the desired location of the planar image 12 with respect to the backing substrate 20 and affix the retaining pockets 30 at the required locations to the second surface 24. The planar image 12 is then engaged by the retaining pockets 30 and the backing substrate 20 and engaged planar image 12 are bonded to the page.

Preferably, the retaining pocket 30 is sufficiently affixed to the backing substrate 20 so that non destructive separation is substantially precluded.

The retaining pockets 30 may have any of a variety of configurations. The retaining pockets 30 may engage a corner of the planar image 12, or an edge of the planar image 12. FIG. 3 shows a second embodiment in which retaining pockets 30 extend along an entire dimension of the planar image 12 along a periphery. FIG. 4 shows the opening 38 which permits retention of a planar image 12.

FIG. 5 shows a configuration of the invention in which a planar image 12 is retained by the retaining pockets 30 with respect to the backing substrate 20. A page 70 of a photo album 60 holds two of the mounting assemblies.

Figure 6:
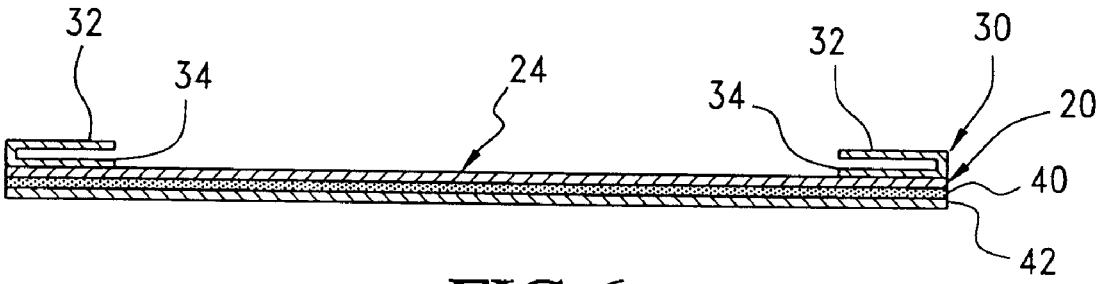
FIG. 6 is an exaggerated cross sectional view taken along lines 6—6 of FIG. 3.

FIG. 6 shows a cross sectional view taken along line 6—6 of FIG. 3 in which the retaining pocket 30 includes the overlying member 22 and the bottom 34 adhered to the second surface 24 of the backing substrate 20. The backing substrate 20, in turn, has the adhesive layer 40 with the releasable film 42.

Thus, the planar image 12 may be displayed without the use of a plastic overlay. Any damage that may result from extended contact between the planar image 12 and a plastic overlay is reduced. In addition, the planar image 12 is readily visible without the distorting effects of a plastic overlay. It is contemplated the backing substrate 20 may be sized and include sufficient retaining pockets 30 to locate two or more planar images 12. Further, the backing substrate 20 may be sized to accommodate any of a variety of photograph sizes.

The present invention offers the benefit of locating the planar image 12 and associated mounting system 10 to a page in the photo album. In prior systems, a user had to balance a corner mount on all four corners of the photograph and then align the photograph with the page, trying to place a balanced corner mounts and photo on the page. In these prior systems, a corner mount invariably fell off or the photograph was misaligned. By mounting the planar image 12 to the substrate 20 prior to aligning with the support, wherein the substrate and the photograph are not be subject to unintended separation, the present invention thus allows accurate alignment with the album page.

In use, the protective film 42 is removed, thereby exposing the adhesive 40. The adhesive 40 and substrate 20 is then affixed to the support 14, with or without the planar image 12. The second surface 24 of the backing substrate 20 has previously adhered retaining pockets 30 which are ready to receive a planar image 12. Simply by inserting an edge of the planar image 12 into the opening 38, the planar image is easily mounted relative to the backing substrate 20.

ALTERNATIVE CONFIGURATIONS

The connection of the retaining pocket 30 to the backing substrate 20 may also be achieved as set forth in FIG. 7. As shown in FIG. 7, a portion of the film 42 is separated from the adhesive 40 adjacent an edge or corner of the substrate 20. An inside surface of the bottom 34 of the retaining pocket 30 is adhered connected to the adhesive 40 such that a portion of the backing substrate 20 is disposed within the pocket opening 38, and the overlying member 32 overlies the second planar surface 24 of the backing substrate.

This attachment of the retaining pocket 30 may be provided for retaining pockets located at the corners or peripheral edges of the substrate 20.

As a portion of the retaining pocket 30 will overlie the photograph, preferably at least the overlying member 32 is formed of an archival material. Thus, the retaining pocket 30 may be of a different material than the backing substrate 20.

An advantage of this construction is the continuous and uninterrupted nature of the second planar surface 24 throughout the footprint of the photograph. That is, the photograph is not subjected to folds or bends or creases at the corners or periphery, formed from overlying an edge of a laminate structure in the backing substrate 20. In addition, this construction provides for the adhesive-free retention of the photograph.

It is also contemplated the retaining pocket 30 maybe formed by the selective folding of an elongate strip or web of archival material 60. Specifically, shown in FIG. 8, the retaining pocket 30 forming strip 60 includes a pair of intersecting fold lines 62, 64 to form the overlying member 32 and the bottom 34, as shown by flaps 34A and 34B.

Referring to FIG. 9, a portion of the underside of the substrate as shown, wherein the flaps 34A and 34B forming the bottom of the retaining pocket 30 are shown adhered to the adhesive 40.

From this configuration, the mounting assembly maybe provided that as the bottom 34 of the retaining pocket 30 is contacted to a portion of the adhesive 40, the overlying film 42 maybe readily grasped in the area of the bottom 34 so that the user may readily remove the film 42 and thus expose a remaining portion of the adhesive 40.

Figure 10:
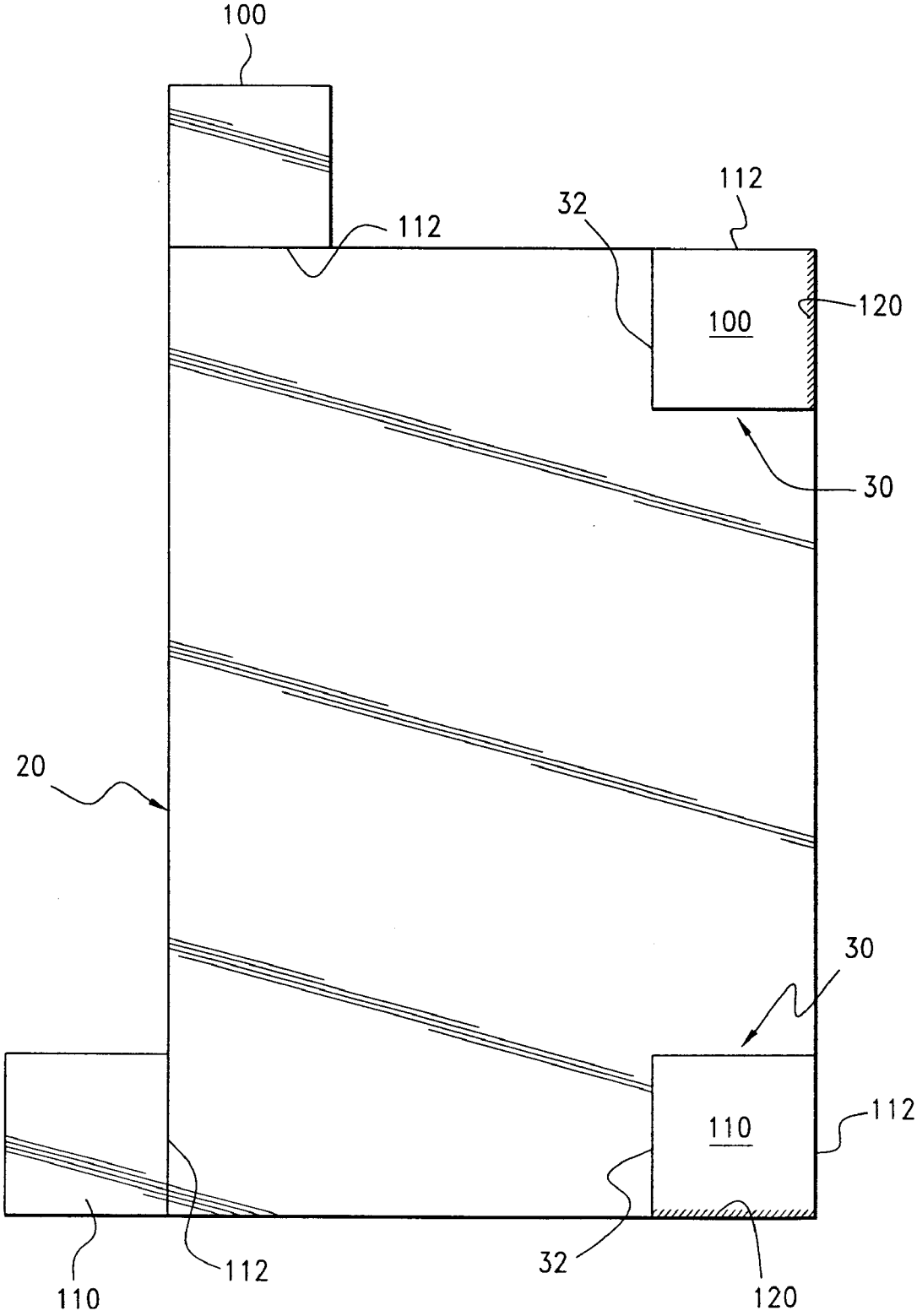
FIG. 10 is a top plan view of a further configuration of the mount assembly.

Referring to FIG. 10, the substrate 20 may be formed or die cut to include flaps which form the pocket 30. In particular, the substrate 20 may include end flaps 100 or side flaps 110 which are folded with respect to the remaining portion of the substrate to form the pocket 30. As shown in the upper left hand corner FIG. 10, end flap 100 is connected to the substrate 20 by fold line 112. To form the pocket, the end flap 100 is folded along fold line 112 and a seam 120 is formed to define the pocket 30. The seam 120 may be formed by any of a variety of mechanisms including adhesives, glues, welding and ultrasonic attachment as shown in the upper right hand corner of FIG. 10. The pocket 30 is partially defined by the fold line 112 and the seam 120, wherein the flap forms the overlying portion.

As shown in bottom left hand corner of FIG. 10, a side flap 110 is attached to the substrate 20 along a fold line 112. To form the pocket 30 as shown in the lower right hand corner of FIG. 10 the side flap 110 is folded along fold line 112 and the seam 120 is formed along the bottom edge of the substrate.

Figure 11:
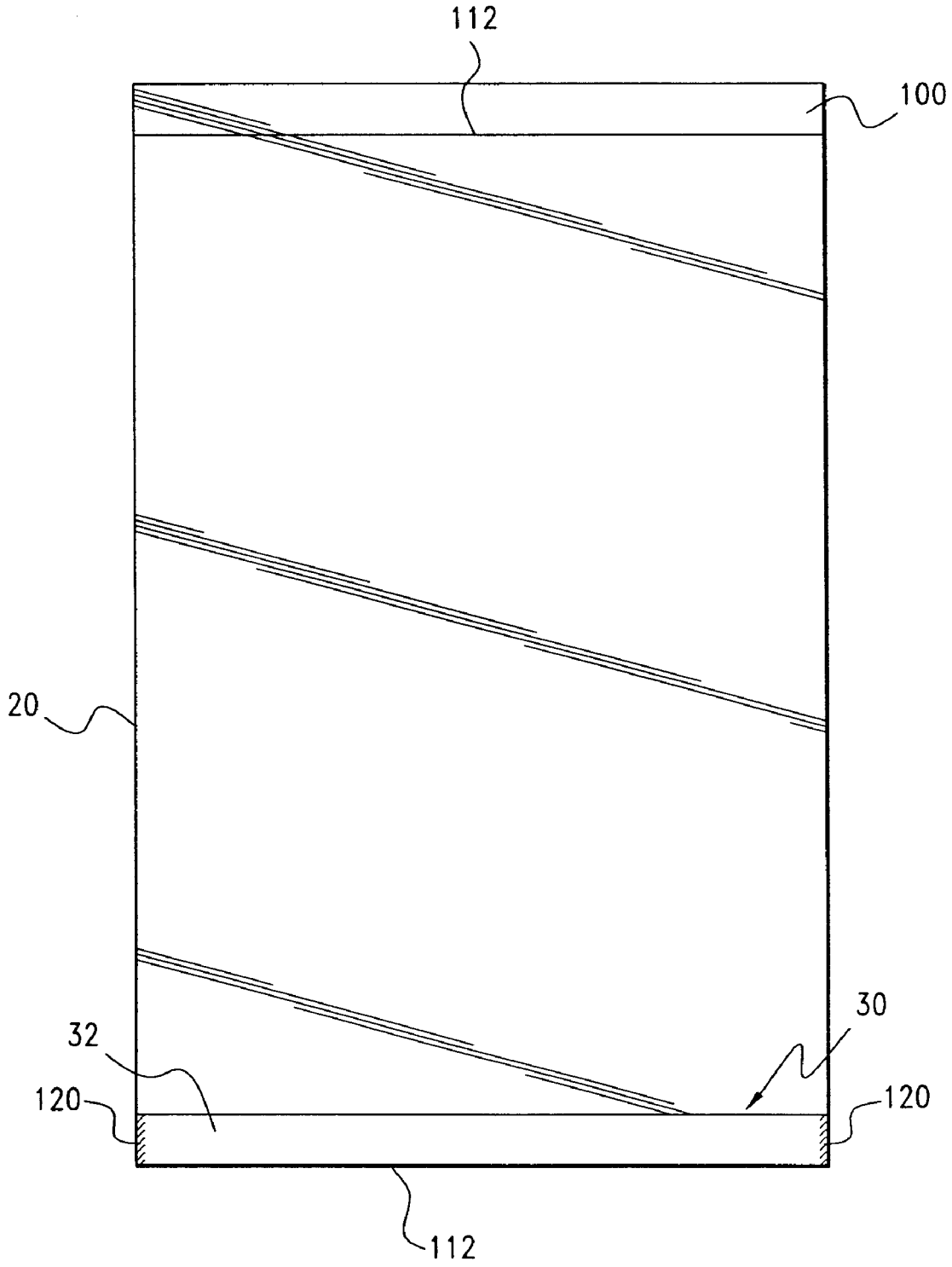
FIG. 11 is a top plan view of further alternative construction of the mount assembly.

Referring to FIG. 11, the end flap 100 may extend across the entire width of substrate 20 along fold line 112. As shown in the bottom of FIG. 11, the pocket 30 is formed by folding end flap 100 about fold line 112 and forming seam 120 along the short edges of the pocket 30.

As shown in FIGS. 12–29, a variety of constructions for a frame configuration of the retaining pocket 30 are shown.

Figure 12:
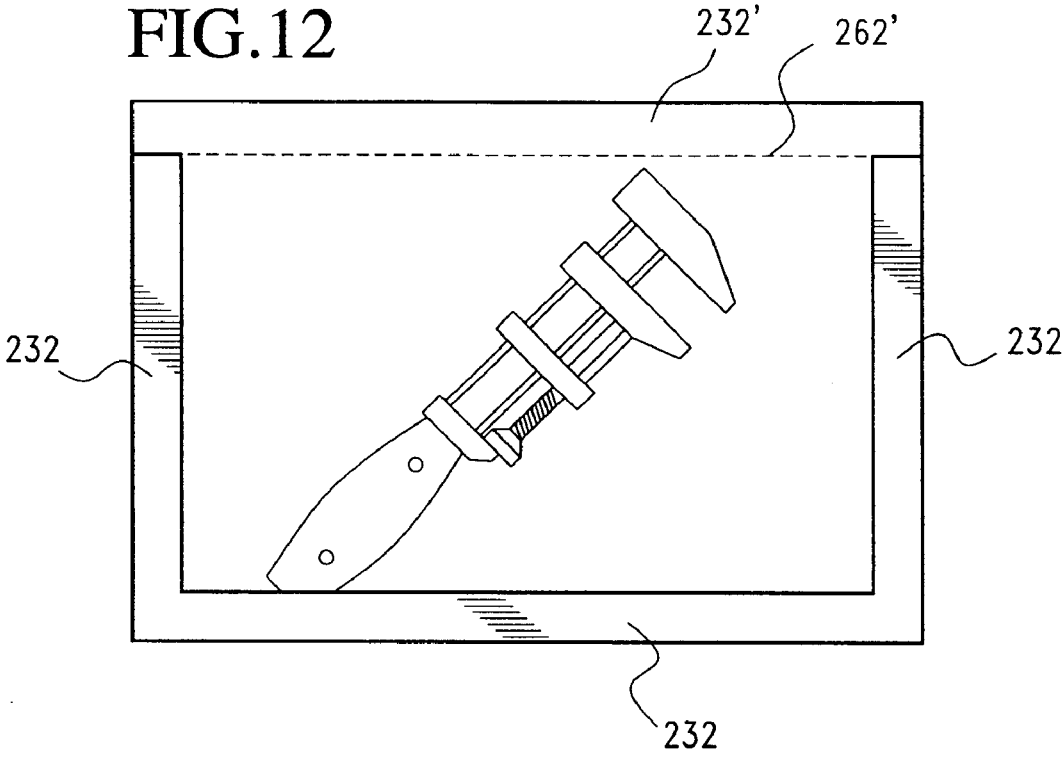
FIG. 12 is a top plan view showing the full frame configuration of the invention.
Figure 13:
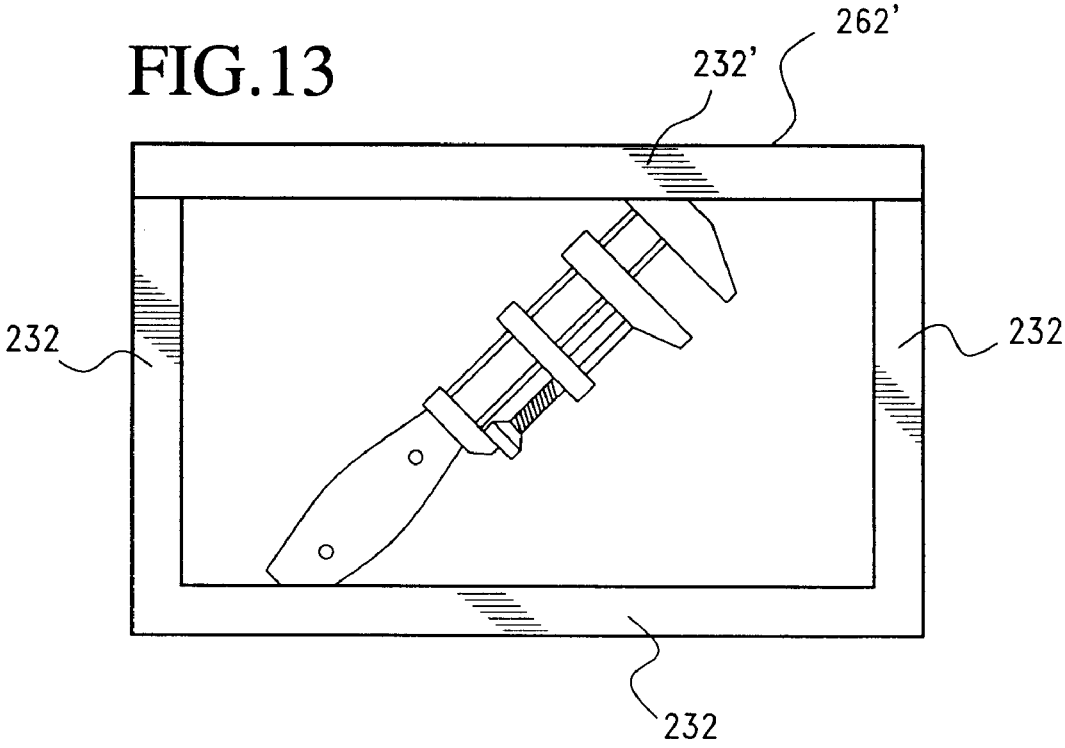
FIG. 13 is a top plan view showing the full frame configuration of the invention retaining a photograph.

Referring to FIG. 12, a photograph of a wrench is shown retained by retaining pocket 30 having an overlying member 232 which overlies three edges of the photograph. The fourth overlying member 232' is shown connected with fold line 262'. To capture the photograph within the retaining pocket, the remaining overlying member 232' is folded along line 262 and thus overlies a portion of the photograph and forms a full frame.

The retaining pockets may thus form a complete envelope contacting the entire periphery of the planar image 12. Alternatively, the retaining pockets 30 may cooperate with the second surface of the backing substrate 20 to retain the planar image 12.

Figure 14:
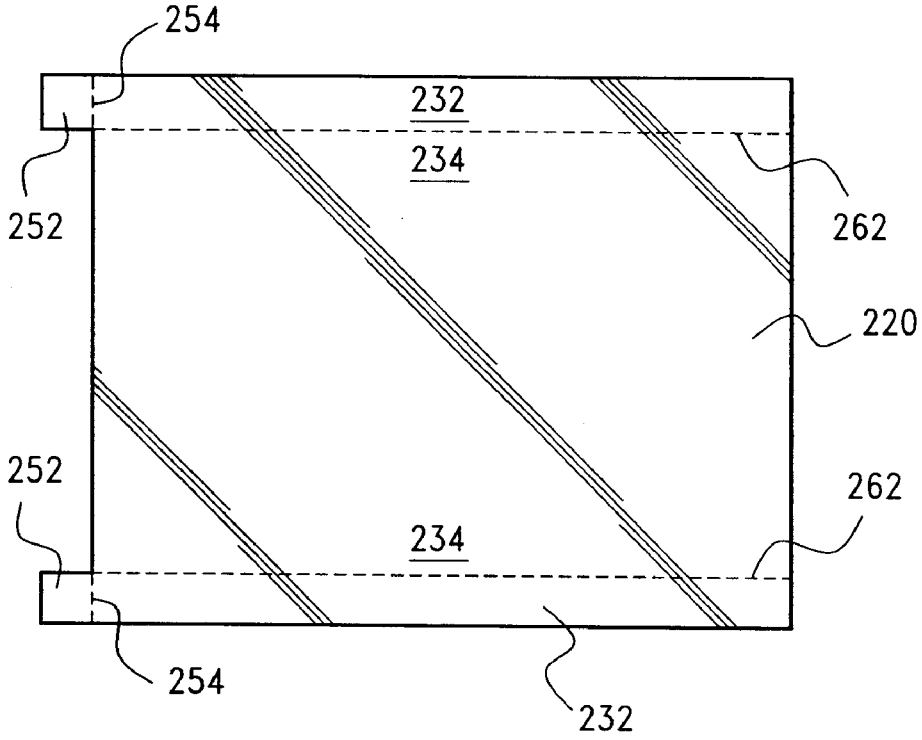
FIG. 14 is a top plan view of a blank for a half frame-three fold configuration.
Figure 15:
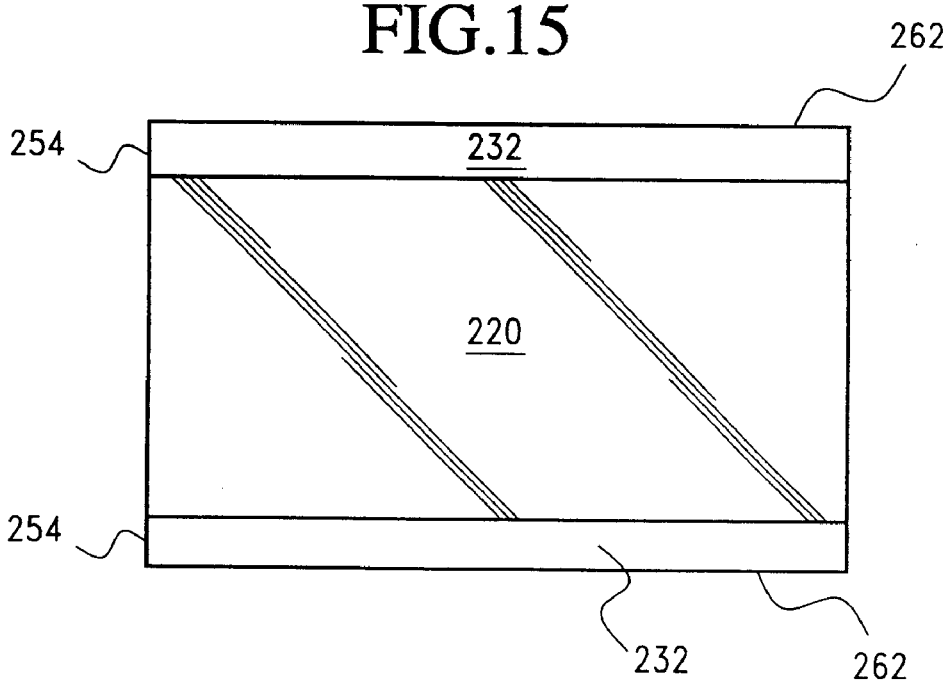
FIG. 15 is a top plan view of the blank of FIG. 14 folded into an operative configuration.

Referring to FIGS. 14 and 15, a retaining pocket 30 for forming a half-frame, three-fold construction is shown. The three fold designation means that a fold (seam) extends along, at least a portion of, three of the four edges of the photograph. Therefore, the planar image 12 can only move in a single direction to separate from the retaining pocket. As seen in FIG. 14, a blank 200 for forming the retaining pocket 30 is shown. The blank 200 is a single contiguous piece of material and is preferably of archival quality. The blank 200 includes a base portion 220 which includes pocket bottoms 234. Overlying members 232 are connected to the base portion 220 along fold lines 262. Tabs 252 are connected to the overlying portions 232 along fold lines 254.

To assemble the blank 200 of FIG. 14, the overlying members 232 are folded along the respective fold lines 262 to overly the base portion 220 and particularly, the pocket bottoms 234. The tabs 252 are folded along the fold lines 254 and may be disposed either between the overlying member 232 and the pocket bottom 234, or alternatively connected to the underside of the base portion such that the pocket is formed entirely by the overlying member 232 and the pocket bottom 234 portion of the base 220. Also, in this construction, the tab 252 may be folded to contact the adhesive layer on the backing substrate 20. Thus, as seen in FIG. 15, a retaining pocket having a half frame, that is, overlying members which extend along two edges of the photograph and having fold lines along three edges of the photograph for retaining the photograph is shown. Typically, the planar image 12 is inserted along the right hand end of the retaining pocket as shown in FIG. 15.

Figure 16:
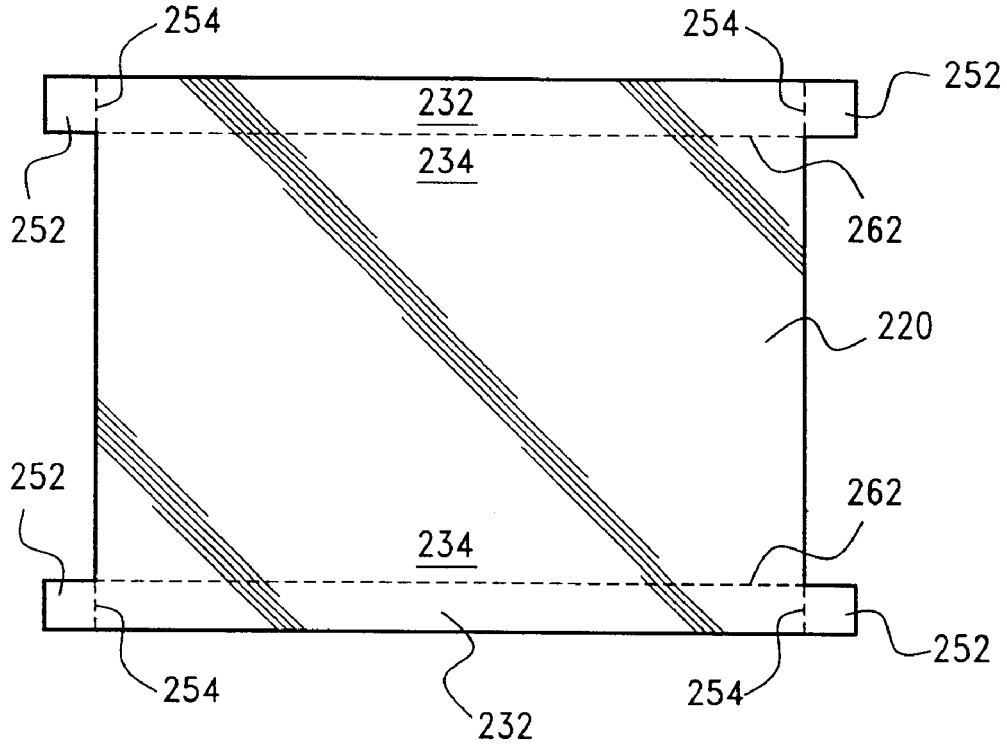
FIG. 16 is a top plan view of a blank for a half frame-four fold configuration
Figure 17:
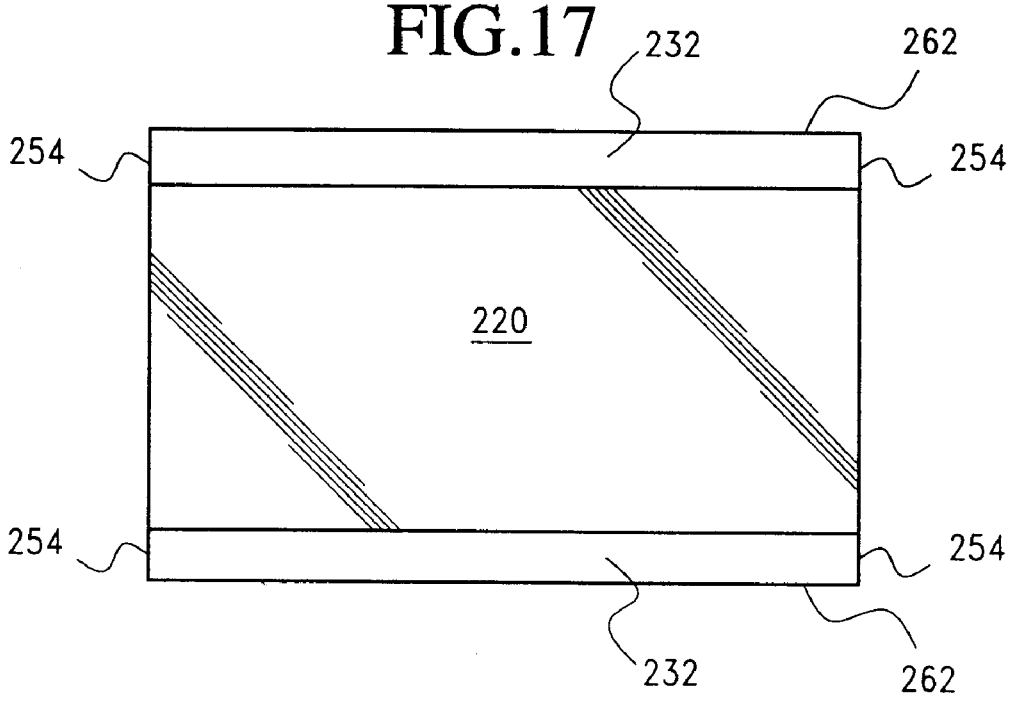
FIG. 17 is a top plan view of the blank of FIG. 16 in an operative position.

Referring to FIGS. 16 and 17, a retaining pocket 30 forming a half frame with four folds is shown. Referring to FIG. 16, a blank 200 of contiguous integral one piece construction includes a base portion 220 with overlying members 232 extending along two edges and connected to the base portion 220 by fold lines 262. The tabs 252 are connected to each end of the respective overlying member 232 along the fold lines 254.

To operably construct the retaining pocket 30, the overlying members 232 are disposed to overly the base portion 220 and particularly a part of the base portion forming the respective pocket bottom 234. The corresponding edges of the photograph are thus retained between the overlying member 232 and the base portion 220, and the tabs 252 may be folded along the respective fold lines 254 to contact a bottom side of the base portion 220 and thus capture the photograph and preclude its removal from the retaining pocket. The tabs 254 can also be folded to be disposed intermediate the overlying member 232 and the base portion 220 (pocket bottom 234). The tab can be affixed in this position by any of a variety of mechanisms including thermal bonding, fusion adhesives or ultrasonic welding. In addition, the tabs 254 can be folded to contact the adhesive layer 40.

Alternatively, one of the overlying members 232 may be folded along the respective fold line 262 and the corresponding tabs 252 folded along fold lines 254 to form a pocket having a pocket opening 238. The product is thus provided to the consumer in this configuration. The consumer then locates one edge of the photograph through the pocket opening 238 to dispose one edge of the photograph within the pocket. The remaining overlying member 232 is then folded about its fold line 262 to overly the photograph. The corresponding tabs 252 are then folded along fold lines 254 to capture the photograph with respect to the retaining pocket 30.

The retaining pocket 30 is then connected to a backing substrate 20 having a double-sided adhesive to retain the photograph relative to a support 14. Thus, in certain configurations the backing substrate 20 may have an adhesive layer on the first surface 22 and the second surface 24.

Figure 18:
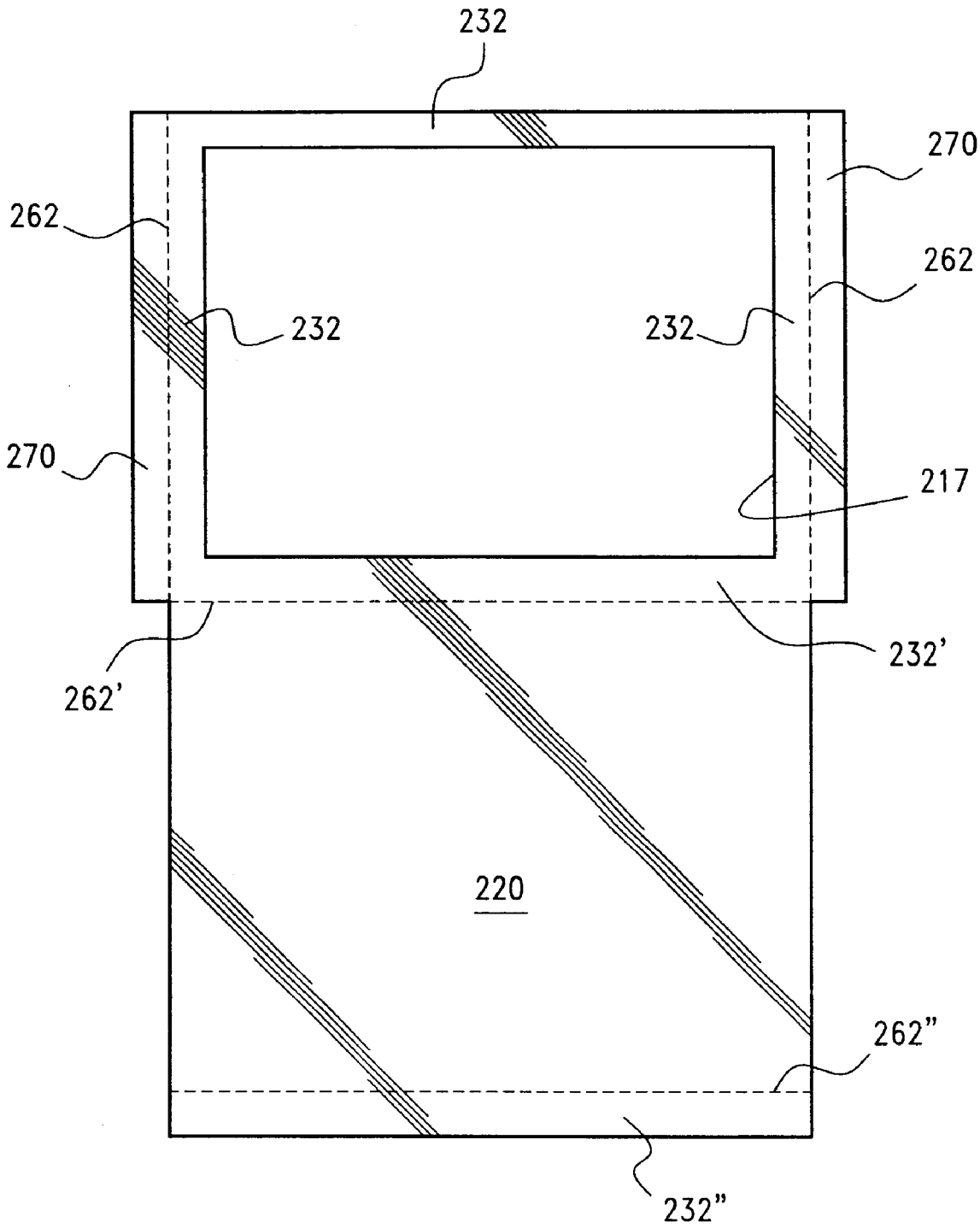
FIG. 18 is a top plan view of a blank for forming a full frame-form fold retainer with a base.

Referring to FIGS. 18–22, a four-sided frame with four folds and the blank 200 constructed to retain the planar image 12 is shown. The blank 200 includes an aperture 217 through which the planar image 12 is viewed. The aperture is defined on four sides by overlying members 232. Two opposing overlying members 232 are connected to corresponding flaps 270 by intermediate fold lines 262. One of the overlying members extends across the top as seen in FIG. 18. A remaining one of the two overlying members 232' is foldably connected along a fold line 262' to a base 220. The base 220 is foldably connected along fold line 262" to an overlying member 232".

Figure 19:
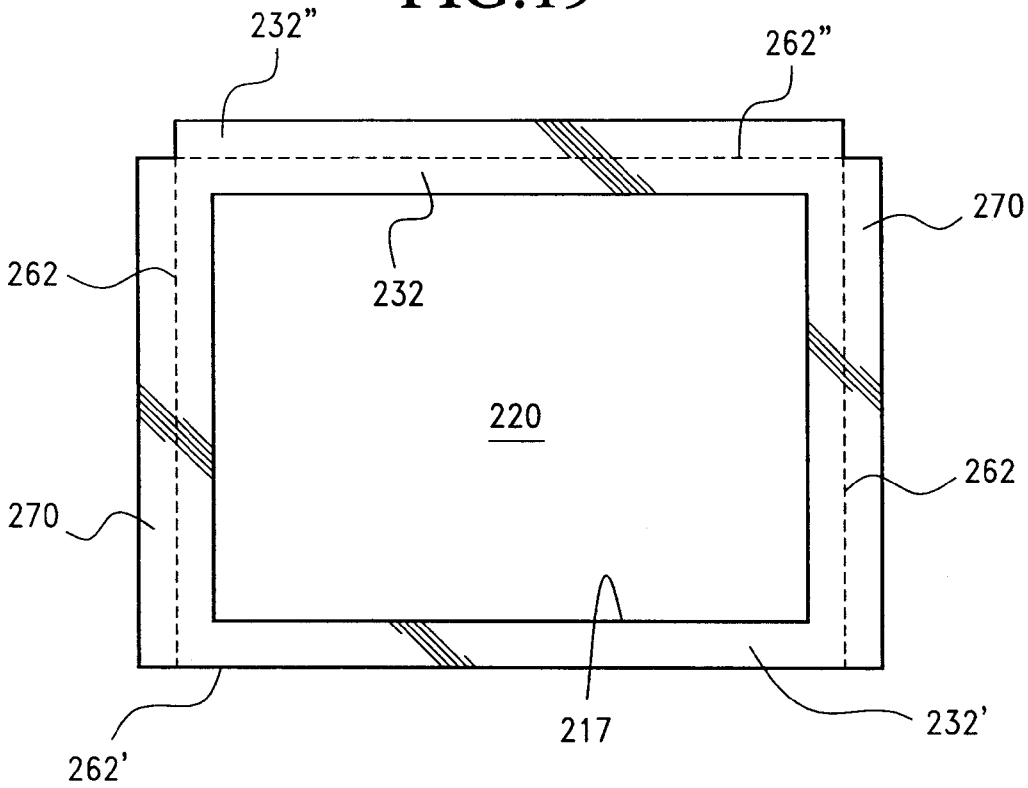
FIG. 19 is a top plan view of a partially folded blank of FIG. 18.

Referring to FIG. 19, the base 220 has been folded along fold line 262 such that a portion of the base 220 is seen through the aperture 217. The overlying member 232" connected to the base 220 is disposed along the top edge in FIG. 19.

Figure 20:
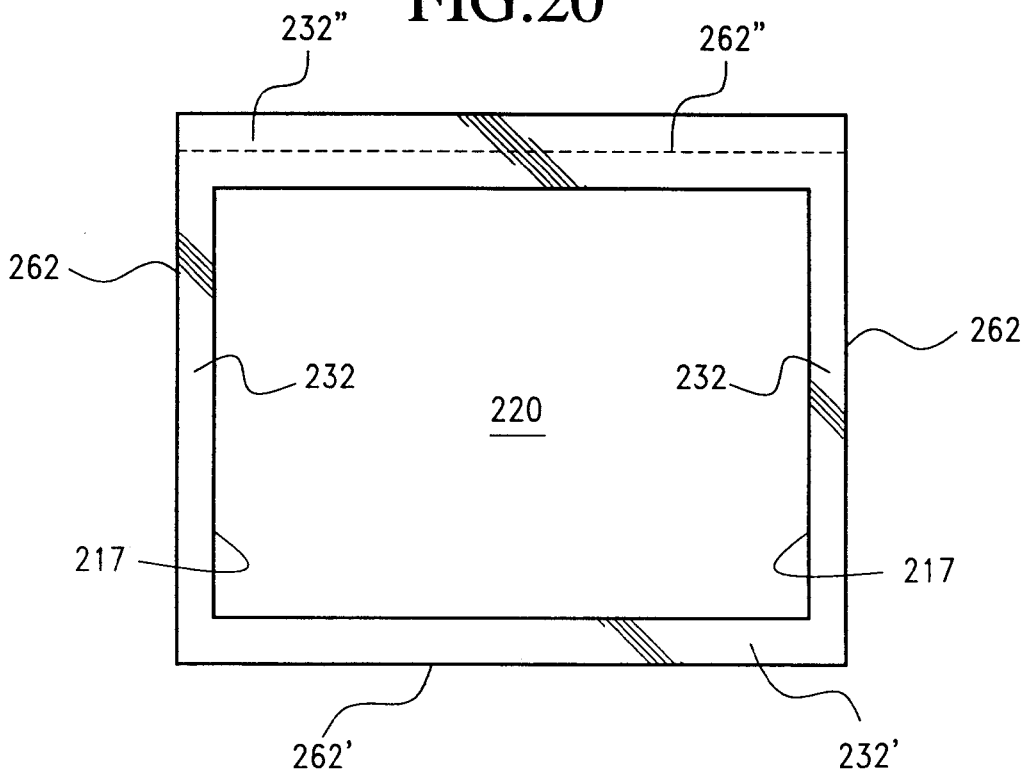
FIG. 20 is a top plan view of the blank of FIG. 19 in a further folded position.

Referring to FIG. 20, flaps 270 have been folded along respective fold lines 262 and cooperate with fold line 262' to form a three-sided pocket. The flaps 270 may be disposed intermediate the overlying member 232 and base 220. Alternatively, the flaps 270 may be disposed intermediate the base 220 and the backing substrate 20. It is also understood, the flaps 270 can be located to contact the adhesive layer 40 on first surface 22 of the backing substrate. The product may be provided to the consumer in this configuration, or in the configuration as shown in FIG. 18.

Figure 21:
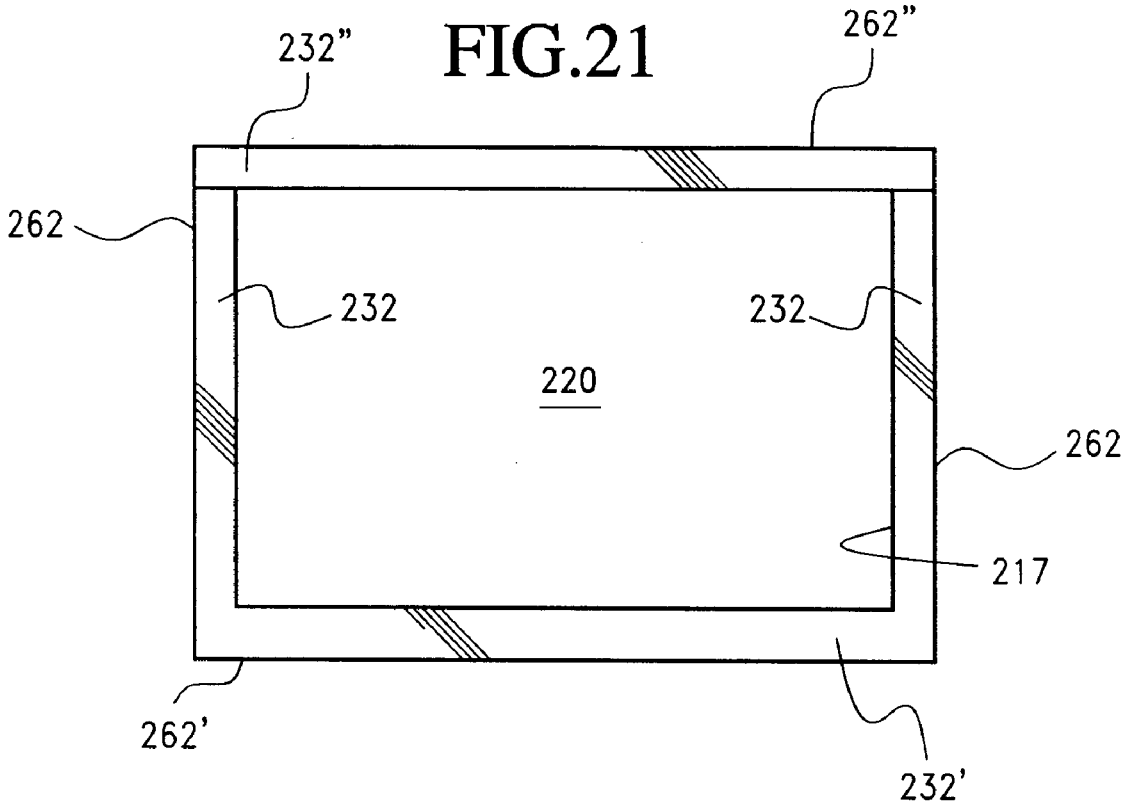
FIG. 21 is a top plan view of the blank of FIGS. 18–20 in a fully folded position.

Referring to FIG. 21, overlying member 232" prime has been folded along fold line 262" to form the fourth fold and thus capture the photograph. The overlying member 232" may be connected to portions of overlying members 232 by adhesives or crimping.

Figure 22:
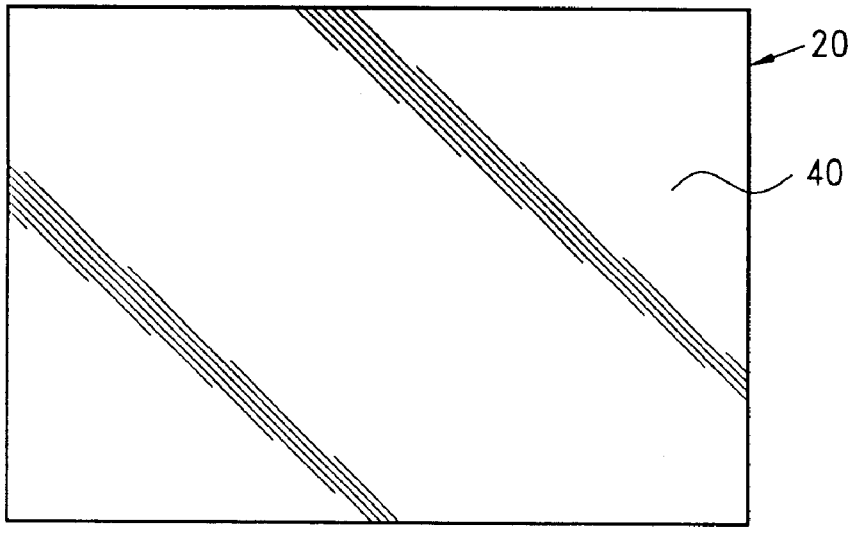
FIG. 22 is a bottom plan view of the backing substrate for attachment to the folded blank of FIG. 21.

As seen in FIG. 22, the backing substrate 20 having adhesive layer 40 is connected to the full frame four fold construction of FIG. 21 to retain the planar image 12 relative to a support 14.

Figure 23:
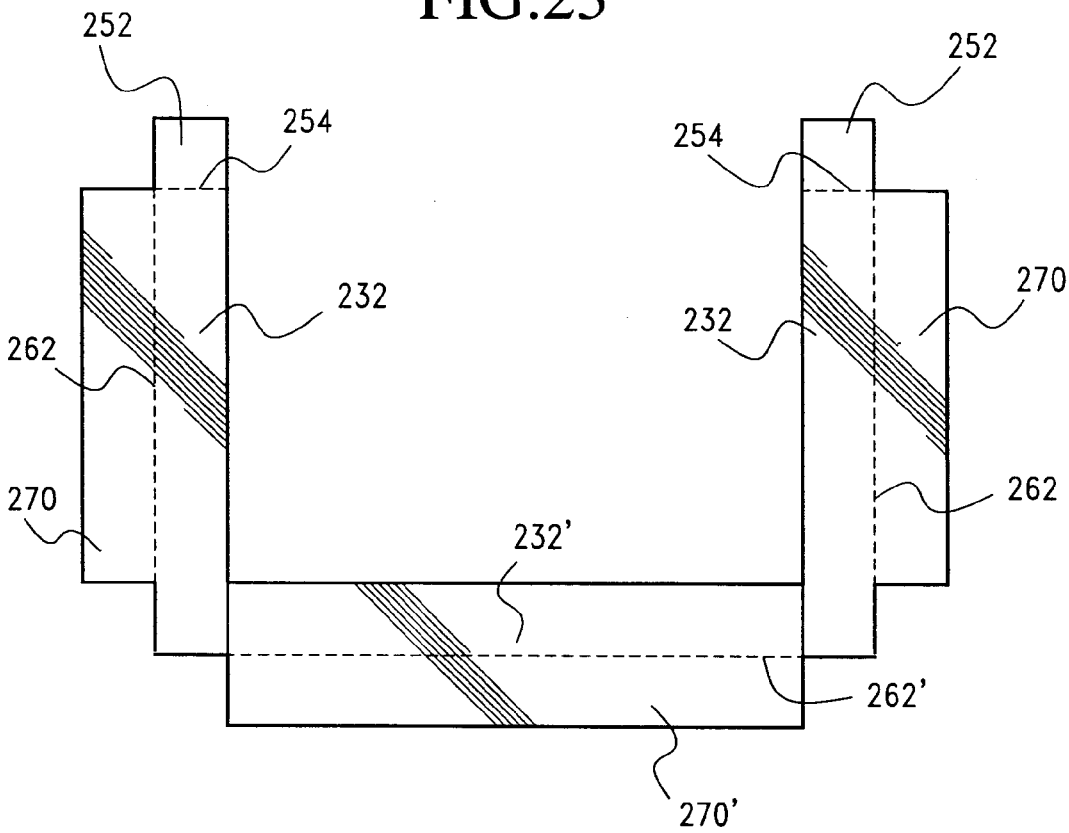
FIG. 23 is a top plan view of a blank for forming a ¾ frame with four folds, wherein the backing substrate is employed to form the base.
Figure 24:
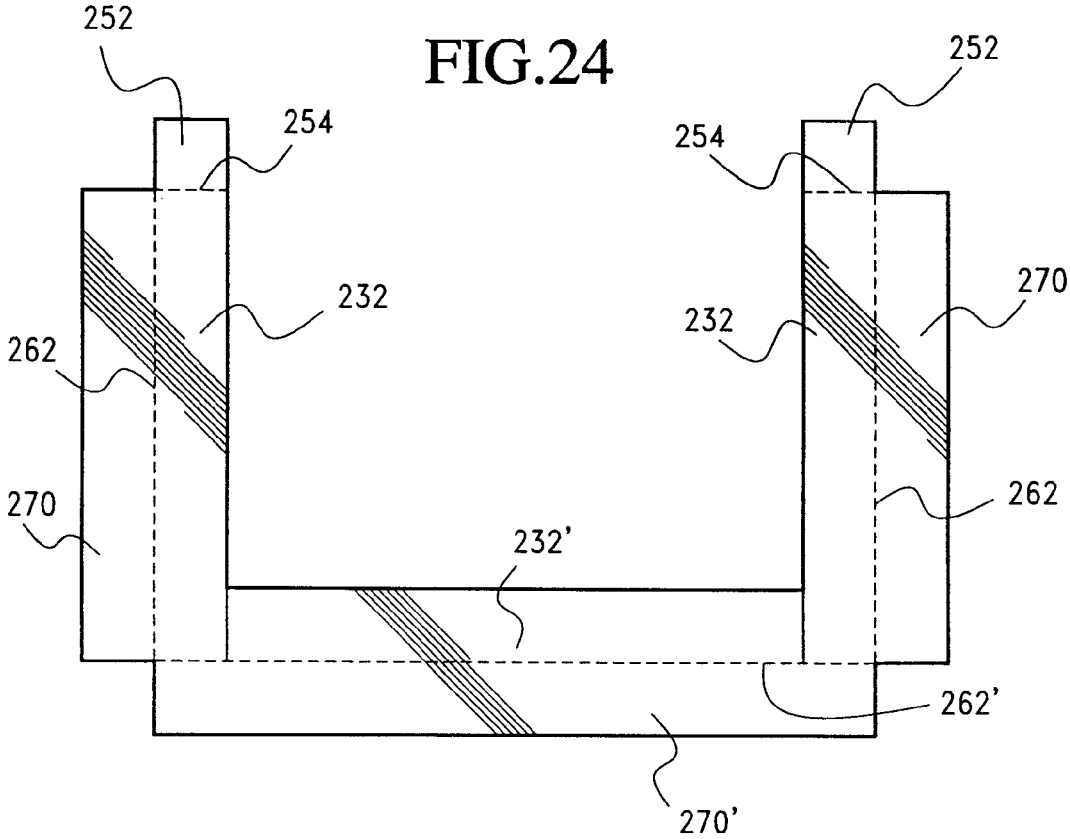
FIG. 24 is a top plan view of an alternative construction of the ¾ frame with four folds, where the backing substrate is employed to form the base.

Referring to FIGS. 23 and 24, a ¾ frame with four folds which cooperates with the second surface 24 of the backing substrate 20 to retain the planar image 12 is shown. The blank 200 includes a pair of opposing parallel overlying members 232 and an interconnecting overlying member 232'. Each of the overlying members 232 is connected to a respective flap 270 along a corresponding fold line 262. Each of the overlying members 232 is connected to a tab 252 along a respective fold line 254. Interconnecting overlying member 232' is connected to flap 270' along fold line 262'.

To form a pocket for receiving a planar image 12 therein, the flaps 270 are folded along corresponding fold lines 262 to either contact the second surface 24 of the backing substrate 20 or the first surface 22 of the backing substrate having the adhesive layer 40. Similarly, flap 270' is folded along fold line 262' to be connected to either a second surface 24 of backing substrate 20 or first surface 22 having adhesive layer 40 thereon.

The product may be provided to the consumer in this configuration, or alternatively, the consumer may perform each of the folding operations. To operably capture the planar image 12, the tabs 252 are folded along respective fold lines 254 to either connect to the second surface 24 of the backing substrate 20 or the first surface 22 of the backing substrate with adhesive layer 40. The planar image 12 is thus captured with overlying members extending along three of the longitudinal edges of the planar image, wherein fold lines extend along a portion of each of the four longitudinal edges of the planar image.

Referring to FIG. 24, an alternative configuration for forming a ¾ frame four fold frame construction is shown. The blank 200 includes opposing parallel overlying members 232 interconnected at one end thereof by overlying member 232'. Each of the overlying members 232 is connected to a respective flap 270 along corresponding fold line 262. A free end of each overlying member 232 is interconnected to tab 252 along fold line 254. Interconnecting overlying member 232' is connected to corresponding flap 270' along fold line 262'.

To form an operable configuration, the flaps 270 are folded along the corresponding fold lines 262 to be connected to either the second surface 24 of the backing substrate 20 or the first surface 22 of the backing substrate and thus to the adhesive layer 40. Similarly, the flap 270' is folded along the fold line 262' to contact either the second surface 24 of the backing substrate 20 or the first surface 22 and corresponding adhesive layer 40. The product may be provided to the consumer in this configuration. Alternatively, the consumer may be responsible for the entire folding. The photograph is then disposed into the pocket 30 from the top through pocket opening 238, as shown in FIG. 24 to have three longitudinal dimensions overlaid by overlying members 232 and 232'. To operably retain the planar image 12, the fourth fold is formed by folding tabs 252 about fold lines 254 and connecting the tabs to either the second surface 24 of the backing substrate 20, or the first surface 22 and the adhesive layer 40.

Figure 25:
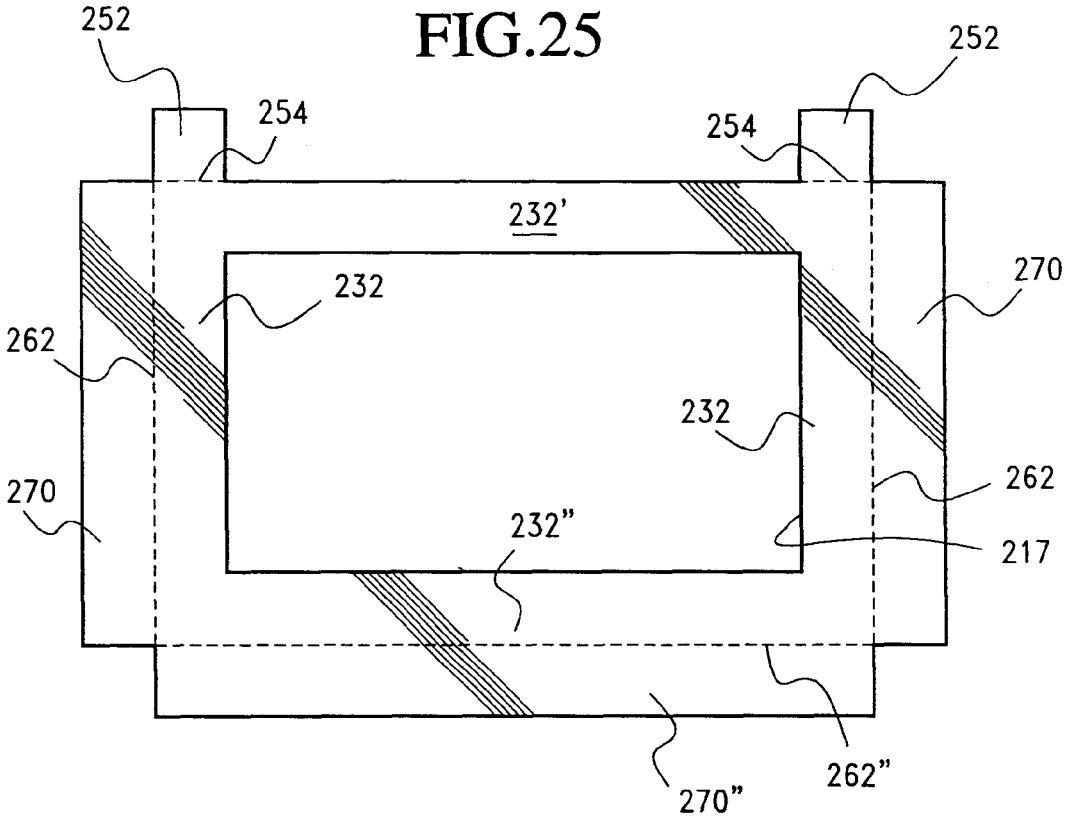
FIG. 25 is a top plan view of a full frame with form folds, wherein the backing substrate is employed to form the base.
Figure 26:
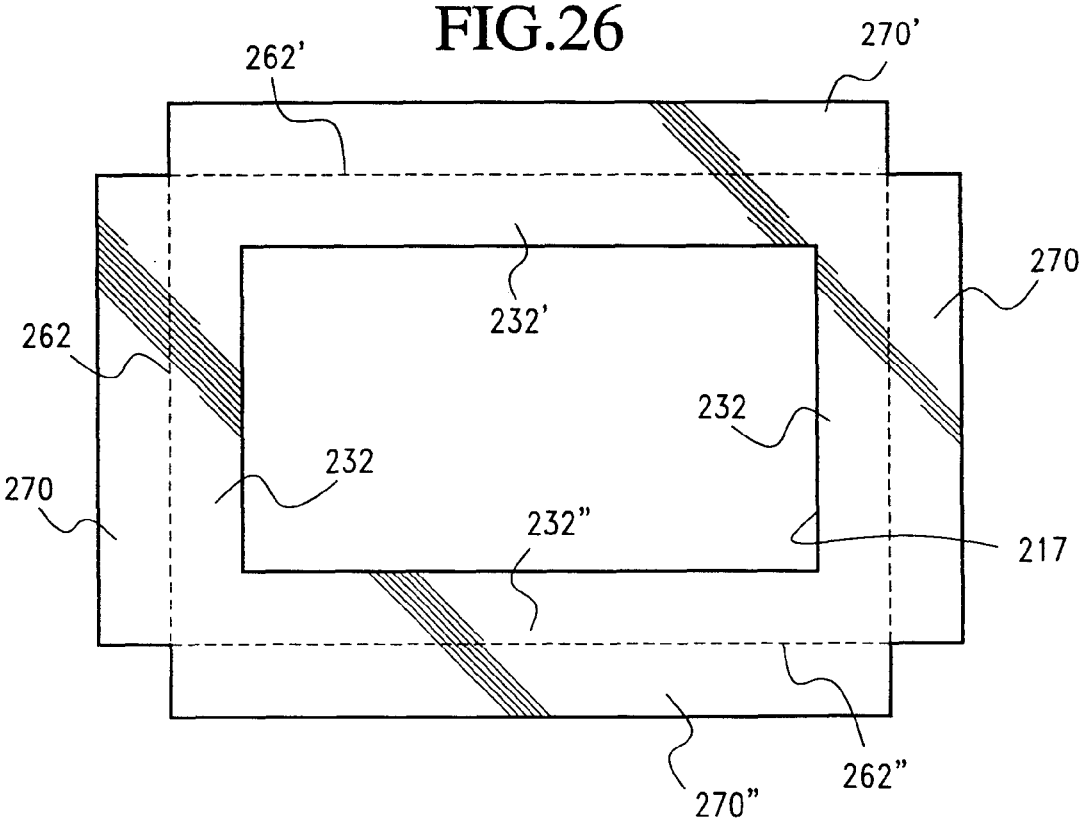
FIG. 26 is a top plan view of a blank for an alternative construction of a full frame with 4 folds, wherein the backing substrate is employed to form the base.

Referring to FIGS. 25 and 26, a full frame four fold construction is shown. The blank 200 includes a central aperture 217 defined by parallel overlying members 232 and parallel overlying members 232' and 232". Each of the overlying members 232 is connected to a corresponding flap 270 along fold line 262. The lower overlying member 232" is connected to a corresponding flap 270" along fold line 262". Upper overlying member 232' is connected to a pair of flaps 252 along corresponding fold lines 254.

To assemble the frame, the flaps 270 are folded along respective fold lines 262 and connected to either the second surface 24 of the backing substrate 20 or the first surface 22 and corresponding to adhesive layer 40. Similarly, the flap 270" is folded along the fold line 262" to contact the second surface 24 of the back substrate 20 or the first surface 22 and corresponding to adhesive layer 40. The product may be provided to the consumer in this configuration. Alternatively, the consumer may be responsible for folding the blank 200 to this configuration.

The photograph is then inserted into the frame such that both overlying members 232" and 232' overly the edge of the planar image 12. To capture the planar image 12, the tabs 252 are folded along the respective fold lines 254 and connected to either the second surface 24 of the backing substrate 20 or surface 22 and corresponding adhesive layer 40.

Referring to FIG. 26, the full frame four fold construction may also be formed from a blank 200. The blank includes a central aperture 217. The aperture 217 is defined by a pair of parallel overlying members 232 and an interconnecting pair of overlying members 232' and 232". The overlying members 232 are connected to corresponding flaps 270 along corresponding fold lines 262. Lower overlying member 232" extends between the parallel spaced apart overlying members 232 and is connected to a corresponding flap 270" along fold line 262". An upper overlying member 232' extends between the upper end of parallel spaced apart overlying members 232 and is connected to a corresponding flap 270' along fold line 262'.

To form an initial pocket structure, the flaps 270 are folded along respective fold lines 262 and connected to either the second surface 24 of the backing substrate 20 or the first surface 22 and corresponding adhesive layer 40. Flap 270" is folded along the fold line 262" to connect to the second surface 24 of the back substrate 20 or the first surface 22 and corresponding adhesive layer 40. The product may be provided to the consumer in this configuration. Alternatively, the consumer may provide the folding operation.

The photograph is then disposed within the pocket 30 through pocket opening 238 such that the opposing parallel overlying members 232 overlie corresponding edges of the photograph and overlying members 232' and 232" overlie the remaining edges. Flap 270' is then folded about fold line 262' to contact either the second surface 24 of the backing substrate 20 or the first surface 22 and corresponding adhesive 40.

Figure 27:
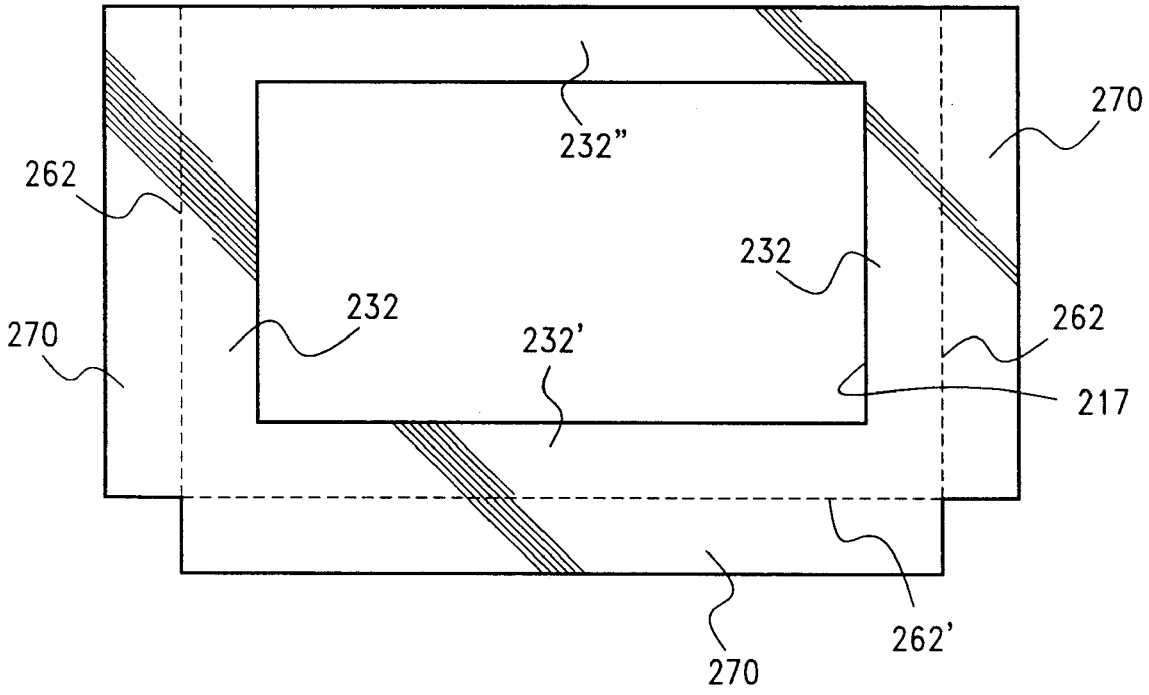
FIG. 27 is a top plan view of a blank for forming a full frame-three fold configuration, wherein the backing substrate is employed to form the base.

Referring to FIG. 27, a full frame ¾ construction is shown. The blank 200 includes aperture 217 defined by a pair of parallel opposing overlying members 232 and parallel opposing overlying members 232' and 232". Each of the overlying members 232 is connected to respective flap 270 along fold line 262. Overlying member 232' is connected to flap 270' along fold line 262'.

To form the retaining structure, the flaps 270 are folded along the respective fold line 262 to contact either the second surface 24 of the backing substrate 20 or the first surface 22 and corresponding adhesive layer 40. Similarly, flap 270' is folded about the fold line 262' to contact the second surface 24 of the backing substrate 20 or the first surface 22 and corresponding adhesive 40. The structure formed thus has a complete frame having overlying members that will extend along each of the longitudinal edges of the planar image 12 while providing a pocket opening 238 for receiving the planar image 12.

Figure 28:
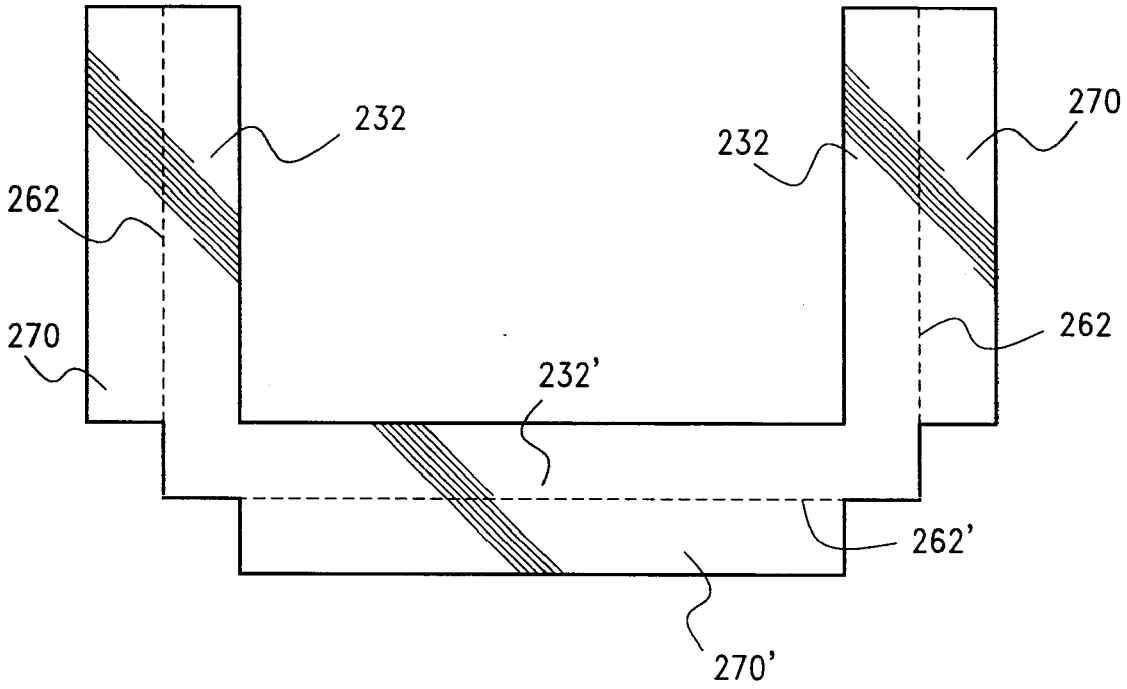
FIG. 28 is a top plan view of a blank for forming a ¾ frame-three fold construction, wherein the backing substrate is employed to form the base.
Figure 29:
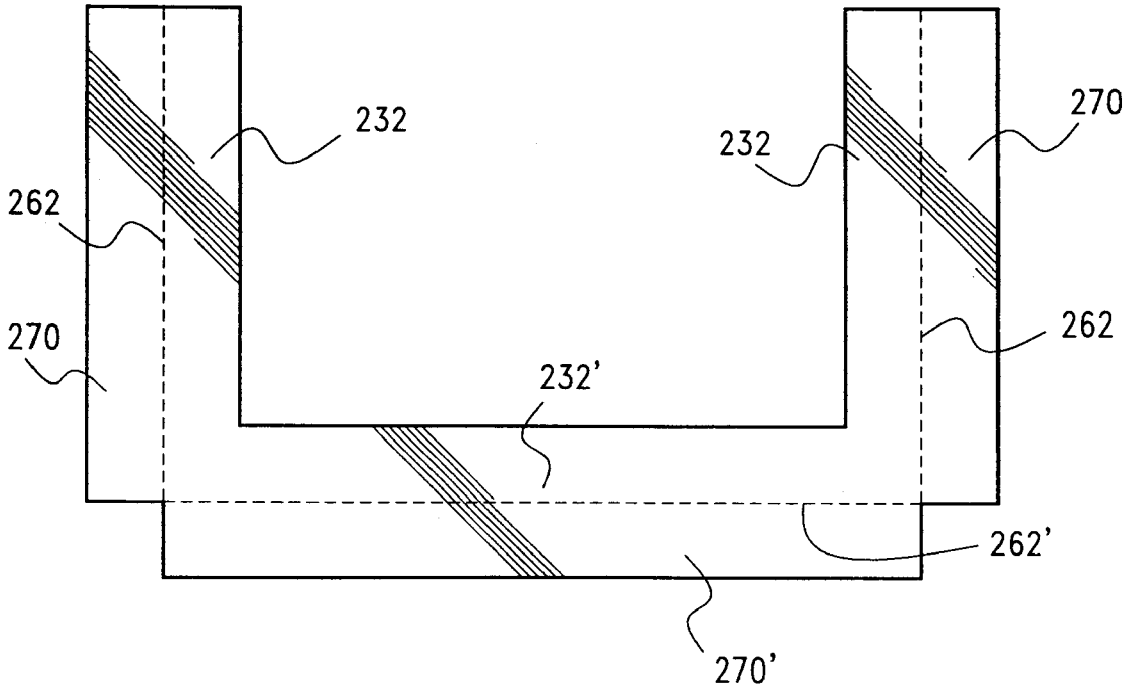
FIG. 29 is a top plan view of an alternative blank for forming a ¾ frame three-fold construction, wherein the backing substrate is employed to form the base.

Referring to FIGS. 28 and 29, a ¾ frame three fold construction is shown. In each of these configurations, the blank 200 is cut to have a pair of parallel opposing overlying members 232 interconnected at one end thereof by overlying member 232'. Each of the opposed spaced apart overlying members 232 is connected to a corresponding flap 270 along a fold line 262. Overlying member 232' is connected to flap 270' along fold line 262'.

To form the retaining pocket, the flaps 270 are folded about respective fold lines 262 to contact either the second surface 24 of the backing substrate 20 or the first surface 22 and the adhesive layer 40. The second surface 24 of the backing substrate 20 thus supports the photograph and the overlying members 232 and 232' retain the photograph relative to the backing substrate.

It is also understood the retaining pocket can be formed such that the overlying members are connected to the backing substrate 20 and the flaps, such as 270, 270' are folded to overlie the periphery of the planar image 12. In these configurations it is anticipated the flaps 270, 280' would be connected to each other by an adhesive or bonding including ultrasonic welding.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. A mount for releasably retaining a generally rectangular planar image relative to a support surface, comprising:

(a) a backing substrate having a first and a second planar surface defined by a rectangular periphery the backing substrate being of a size sufficient to accommodate the entire planar image;

(b) an adhesive layer on the first surface of the backing substrate for adhering the backing substrate to the support surface;

(c) a removable film on the adhesive layer; and (d) a retaining pocket on the second surface forming a frame encompassing three edges of the backing substrate, the retaining pocket having a bottom wall and an overlying top wall, the retaining pocket formed of a different material than the backing substrate and providing retention along the entire length of a side of the planar image.

2. The mount of claim 1, wherein the bottom wall is connected to the backing substrate to preclude non destructive separation.

3. The mount of claim 1, wherein the bottom wall and the top wall are an integral contiguous piece of material.

4. The mount of claim 1, wherein the bottom wall is of a size sufficient to overlie the entire second surface.

5. The mount of claim 1, wherein the retaining pocket is substantially transparent.

6. The mount of claim 1, wherein the retaining pocket is opaque.

7. A mount for releasably retaining a planar image relative to a support, comprising:

(a) a backing substrate having a first and a second planar surface defined by a rectangular periphery;

(b) an adhesive layer on the first surface of the backing substrate;

(c) a removable film on the adhesive layer; and (d) an integral one piece retaining pocket connected to the backing substrate, the retaining pocket including a pair of parallel spaced apart overlying members extending along an entire length of a side of the rectangular periphery, each overlying member connected to a tab extending beyond the periphery of the backing substrate.

8. The mount of claim 7, wherein the retaining pocket and the backing substrate are formed of different material.

9. The mount of claim 7, wherein the retaining pocket is substantially transparent.

10. The mount of claim 7, wherein the retaining pocket is opaque.

11. A mount for releasably retaining a planar image relative to a support, comprising:

(a) a backing substrate having a first and a second planar surface defined by a rectangular periphery;

(b) an adhesive layer on the first surface of the backing substrate;

(c) a removable film on the adhesive layer; and (d) a retaining frame formed of a contiguous piece of material and having a first pair of spaced parallel overlying members and a second pair of overlying members defining an aperture, each of the overlying members connected to a corresponding flap along the entire length of a corresponding fold line.

12. The mount of claim 11, wherein the retaining frame is substantially transparent.

13. The mount of claim 11, wherein the retaining frame is opaque.

14. A mount for releasably retaining a planar image relative to a support, comprising:

(a) a backing substrate having a first and a second planar surface defined by a rectangular periphery;

(b) an adhesive layer on the first surface of the backing substrate;

(c) a removable film on the adhesive layer; and (d) a retaining pocket including a pocket bottom and foldable overlying member contiguous and coplanar with the pocket bottom the overlying member extending along an entire length of a side of the rectangular periphery and moveable from the coplanar position to a non-coplanar parallel position to dispose a portion of the planar image between the pocket bottom and the overlying member.

15. The mount of claim 14, further comprising an adhesive intermediate the pocket bottom and the backing substrate.

16. The mount of claim 14, wherein the retaining pocket is substantially transparent.

17. The mount of claim 14, wherein the retaining pocket is substantially translucent.

18. The mount of claim 14, wherein the retaining pocket is opaque.

* * * * *